US011731031B2

(12) United States Patent
Hollyfield

(10) Patent No.: US 11,731,031 B2
(45) Date of Patent: Aug. 22, 2023

(54) MODULAR SKATEBOARD ASSEMBLY

(71) Applicant: Gary Hollyfield, Blue Island, IL (US)

(72) Inventor: Gary Hollyfield, Blue Island, IL (US)

( * ) Notice: Subject to any disclaimer, the term of this patent is extended or adjusted under 35 U.S.C. 154(b) by 0 days.

(21) Appl. No.: 17/464,028

(22) Filed: Sep. 1, 2021

(65) Prior Publication Data

US 2023/0069474 A1 Mar. 2, 2023

(51) Int. Cl.
*A63C 17/26* (2006.01)
*A63C 17/01* (2006.01)

(52) U.S. Cl.
CPC ..... *A63C 17/26* (2013.01); *A63C 17/012* (2013.01); *A63C 17/015* (2013.01); *A63C 17/262* (2013.01); *A63C 2203/06* (2013.01)

(58) Field of Classification Search
CPC ..... A63C 17/26; A63C 17/012; A63C 17/015; A63C 17/262; A63C 2203/06; A63C 10/04; A63C 2009/008; A63C 9/005; A63C 17/0086; A63C 17/014; A63C 2017/0053; A63C 5/128; A63C 9/00
See application file for complete search history.

(56) References Cited

U.S. PATENT DOCUMENTS 4,062,557 A 12/1977 Rodea
5,382,052 A * 1/1995 Tarng ..... A63C 17/01 280/844
5,401,041 A * 3/1995 Jespersen ..... A43B 5/0401 280/619
5,417,444 A * 5/1995 Chen ..... A63C 17/26 280/7.15
5,769,438 A 6/1998 Svetlov
D397,753 S 9/1998 Lin
5,855,390 A * 1/1999 Hassell ..... A63C 10/28 280/607
5,947,495 A 9/1999 Null
6,196,558 B1 * 3/2001 Simon ..... A63C 5/03 280/14.22
6,631,913 B2 10/2003 Godfrey
6,776,427 B2 8/2004 Glover
D530,765 S * 10/2006 Rojas ..... D21/760
8,459,670 B1 * 6/2013 Tizzone ..... A63C 17/015 280/87.05
9,808,704 B1 * 11/2017 Crossland ..... A63C 17/017
(Continued)

FOREIGN PATENT DOCUMENTS

AT 502887 A2 * 6/2007 ..... A63C 5/044
CN 1499990 A * 5/2004 ..... A63C 9/0844
(Continued)

*Primary Examiner* — James A Shriver, II
*Assistant Examiner* — Michael T. Walsh

(57) ABSTRACT

A modular skateboard assembly for enabling a user to employ a pair of skateboards in the convention of a skateboard or roller skates includes a pair of skateboards which each includes a pair of rollers that roll along a support surface. Each of the skateboards is attachable to the other skateboard such that the pair of skateboards extends along a common axis thereby facilitating the pair of skateboards to be employed in the common convention of skateboards. Furthermore, each of the skateboards is detachable from the other skateboard thereby enabling the pair of skateboards to be employed in the common convention of roller skates. Each of the skateboards includes a pair of foot restraints to restrain the user's feet.

8 Claims, 7 Drawing Sheets

(56) References Cited

U.S. PATENT DOCUMENTS

| | | | | |
|---|---|---|---|---|
| 2003/0046829 | A1* | 3/2003 | Baechtold | A43B 5/0421 36/15 |
| 2014/0042728 | A1* | 2/2014 | Noyes | A63C 10/18 280/612 |
| 2022/0387877 | A1* | 12/2022 | DeGraff | A43B 5/0403 |

FOREIGN PATENT DOCUMENTS

| | | | | | |
|---|---|---|---|---|---|
| CN | 201279381 | Y | * | 7/2009 | |
| CN | 215232040 | U | * | 12/2021 | |
| DE | 20007978 | U1 | * | 7/2000 | A63C 17/01 |
| DE | 202016006605 | U1 | * | 1/2017 | |
| EP | 1106215 | A2 | * | 6/2001 | A63C 10/18 |
| KR | 200390119 | Y1 | * | 7/2002 | |
| KR | 200390119 | Y1 | * | 7/2005 | |
| WO | WO03064241 | | | 8/2003 | |
| WO | WO-2017222312 | A1 | * | 12/2017 | A63C 17/0013 |

* cited by examiner

MODULAR SKATEBOARD ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to skateboard devices and more particularly pertains to a new skateboard device for enabling a user to employ a pair of skateboards in the convention of a skateboard or roller skates. The device includes a pair of skateboards that are attachable to the other skateboard in a linear orientation such that the pair of skateboards can be employed in the convention of a skateboard. The pair of skateboards is detachable from the other skateboard such that the pair of skateboards can be employed in the convention of roller skates. Additionally, each of the pair of skateboards includes foot restraints for restraining a user's feet on each of the skateboards.

(2) Description of Related Art Including Information Disclosed Under 37 CFR 1.97 and 1.98

The prior art relates to skateboard devices including a skateboard that includes a pair of rollers which each includes more than two wheels. The prior art discloses a variety of skateboard devices which includes a board that has a hinge integrated into the board to facilitate the board to be folded for storage. The prior art discloses an all-terrain skateboard device that includes foot restraints and articulating suspension. The prior art discloses a skateboard that can be broken in half to facilitate the skateboard to be more easily carried.

BRIEF SUMMARY OF THE INVENTION

An embodiment of the disclosure meets the needs presented above by generally comprising a pair of skateboards which each includes a pair of rollers that roll along a support surface. Each of the skateboards is attachable to the other skateboard such that the pair of skateboards extends along a common axis thereby enabling the pair of skateboards to be employed in the common convention of skateboards. Furthermore, each of the skateboards is detachable from each other thereby facilitating the pair of skateboards to be employed in the common convention of roller skates. Each of the skateboards includes a pair of foot restraints to restrain a respective one of a user's feet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
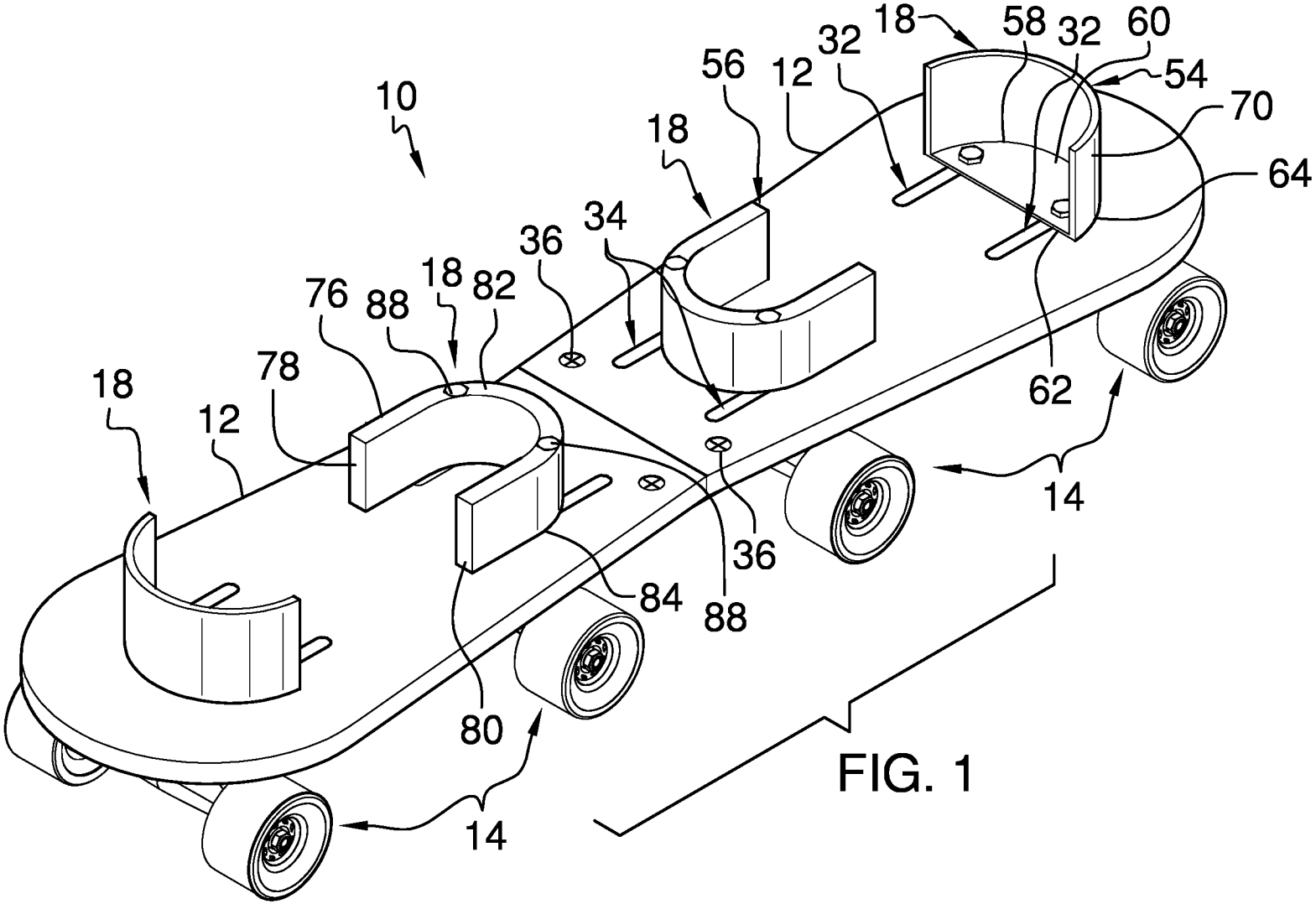
FIG. 1 is a top perspective view of a modular skateboard assembly according to an embodiment of the disclosure.
Figure 2:
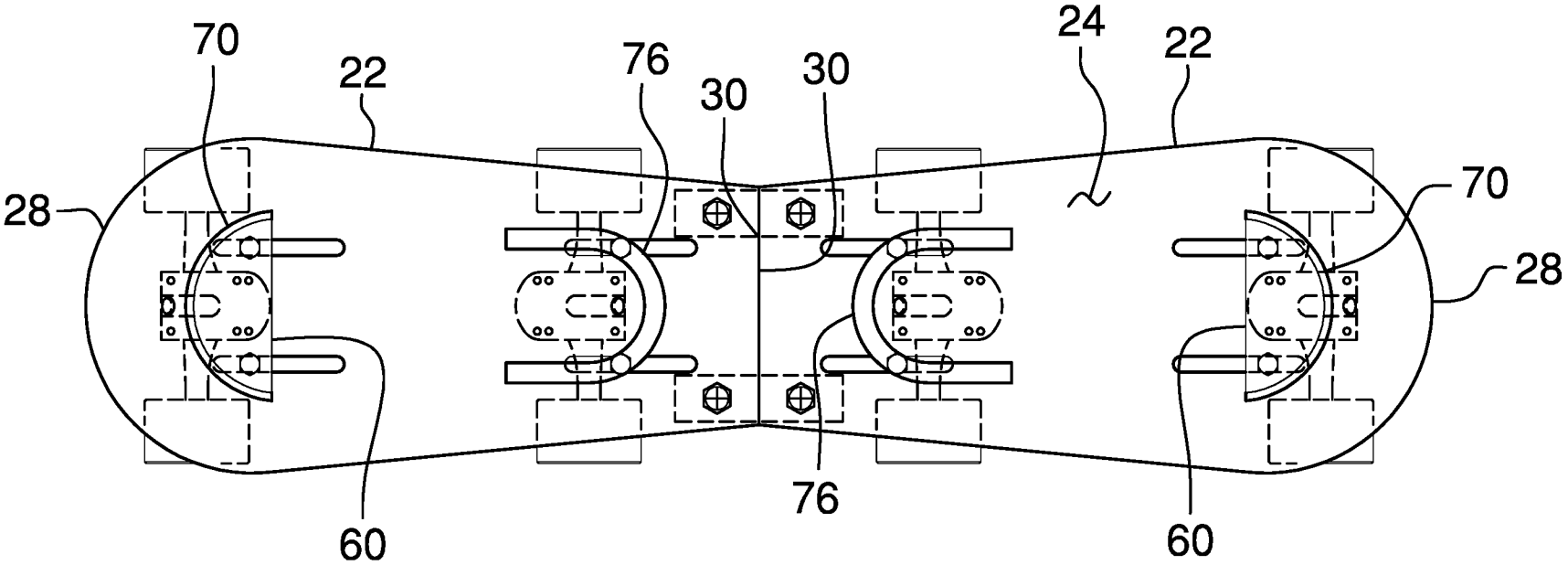
FIG. 2 is a bottom phantom view of an embodiment of the disclosure.
Figure 3:
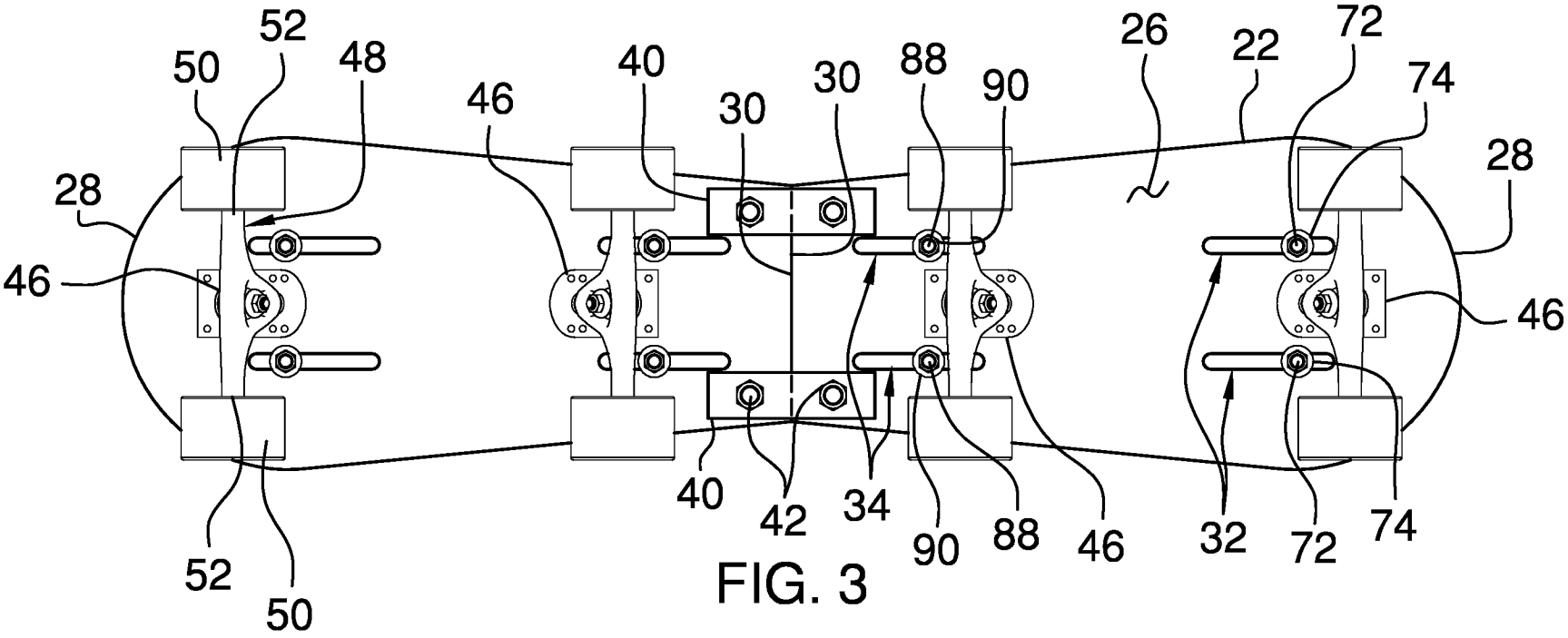
FIG. 3 is a bottom view of an embodiment of the disclosure.
Figure 4:
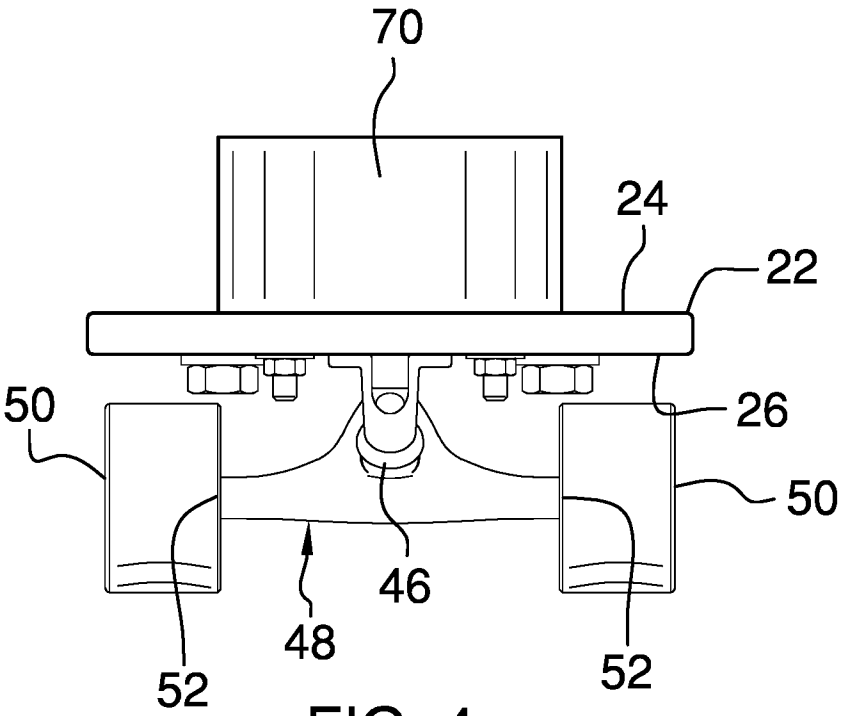
FIG. 4 is a front view of an embodiment of the disclosure.
Figure 5:
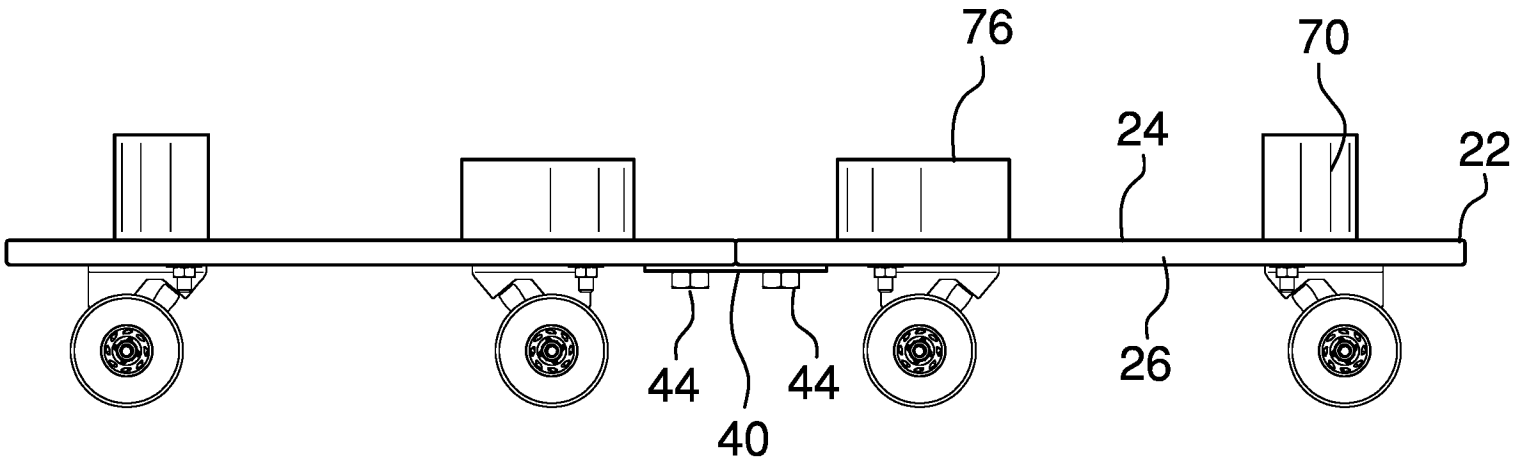
FIG. 5 is a right side view of an embodiment of the disclosure.
Figure 6:
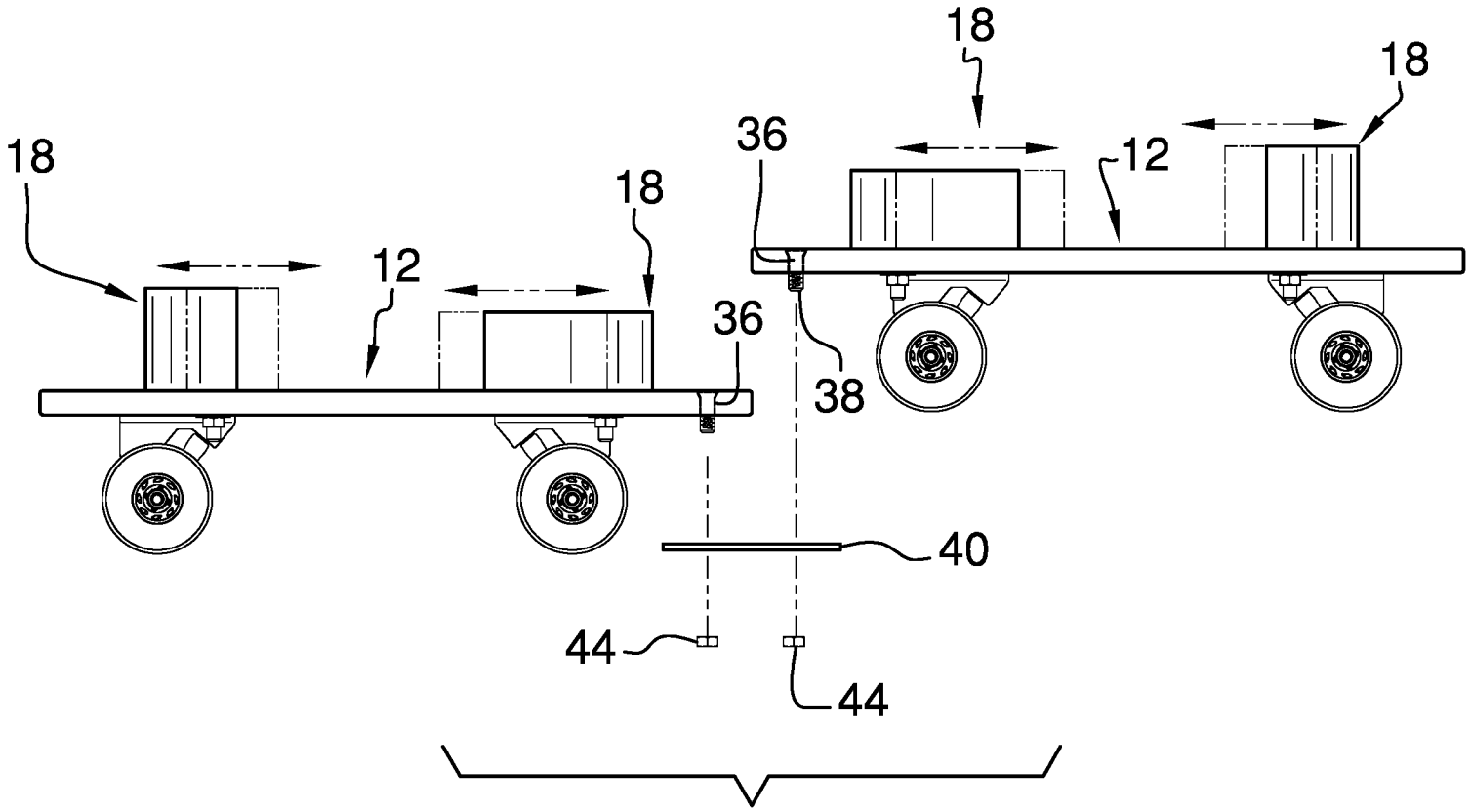
FIG. 6 is an exploded perspective view of an embodiment of the disclosure showing a pair of skateboards being detached from each other.
Figure 7:
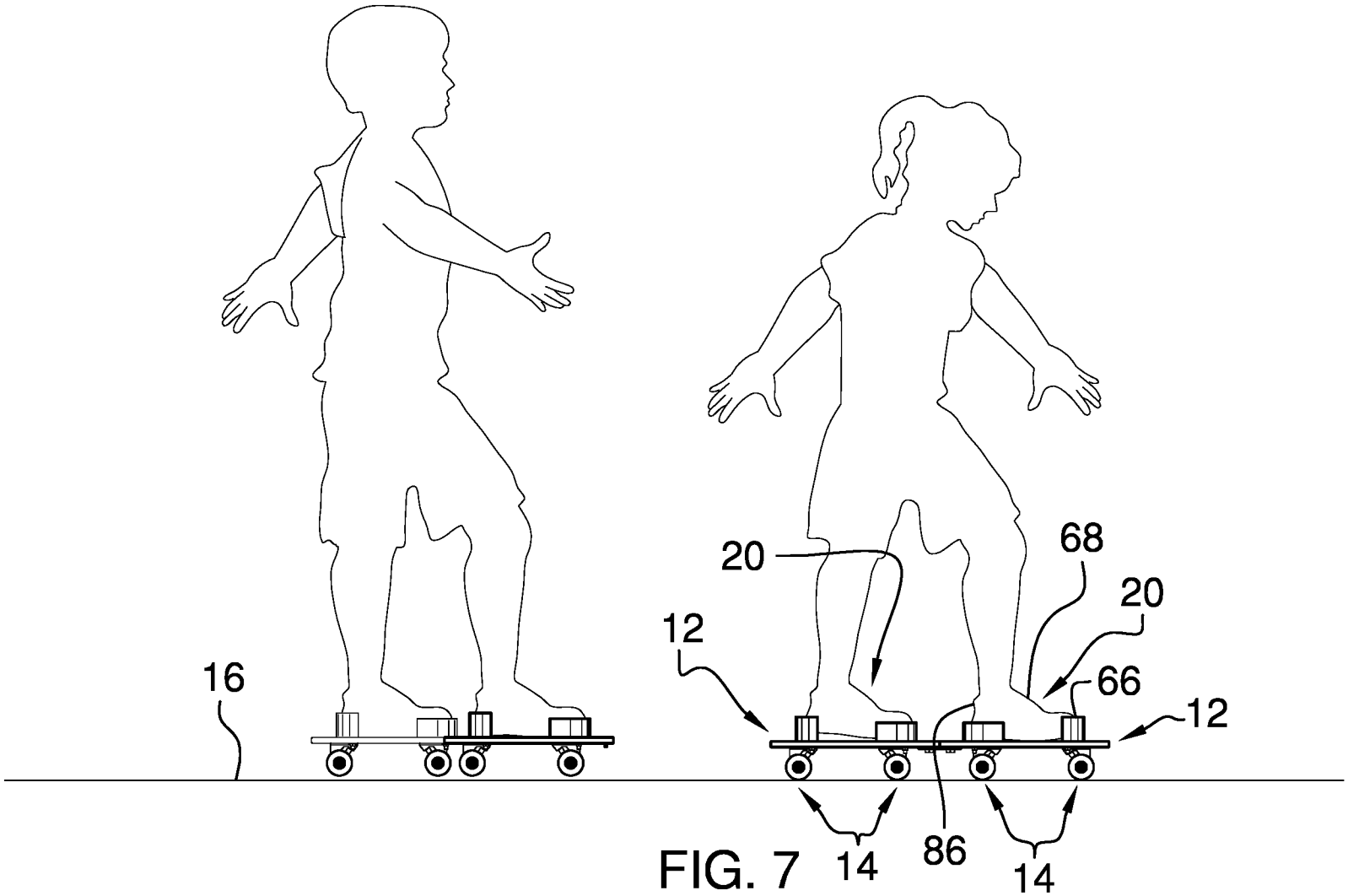
FIG. 7 is a perspective in-use view of an embodiment of the disclosure.

With reference now to the drawings, and in particular to FIGS. 1 through 7 thereof, a new skateboard device embodying the principles and concepts of an embodiment of the disclosure and generally designated by the reference numeral 10 will be described.

As best illustrated in FIGS. 1 through 7, the modular skateboard assembly 10 generally comprises a pair of skateboards 12 which includes a pair of rollers 14 to roll along a support surface 16. Each of the skateboards 12 is attachable to the other skateboard 12 such that the pair of skateboards 12 extends along a common axis. In this way the pair of skateboards 12 can be employed in the common convention of skateboards. Conversely, each of the skateboards 12 is detachable from the other skateboard 12 thereby enabling the pair of skateboards 12 to be employed in the common convention of roller skates. Each of the skateboards 12 includes a pair of foot restraints 18 to restrain a respective one of a user's feet 20.

Each of the skateboards 12 comprises a board 22 that has a top surface 24, a bottom surface 26, a first end 28 and a second end 30, and the board 22 is elongated between the first end 28 and the second end 30. The first end 28 is rounded and the second end 30 is flattened. The board 22 has a pair of first slots 32 each extending through the top surface 24 and the bottom surface 26. Each of the first slots 32 is oriented parallel to an axis extending between the first end 28 and the second end 30. Additionally, the first slots 32 are spaced apart from each other and are oriented parallel to each other and each of the first slots 32 is positioned closer to the first end 28 than the second end 30.

The board 22 has a pair of second slots 34 each extending through the top surface 24 and the bottom surface 26. Each of the second slots 34 is oriented parallel to an axis extending between the first end 28 and the second end 30. The second slots 34 are spaced apart from each other and is oriented parallel to each other and each of the second slots 34 is positioned closer to the first end 28 than the second end 30. Furthermore, the second end 30 of the board 22 associated with each of the skateboard 22 abuts each other when the pair of skateboards 12 is attached to the other skateboard 12.

Each of the skateboards 12 includes pair of bolts 36 which each extends downwardly through the top surface 24 and the bottom surface 26 of the board 22. Each of the bolts 36 has a distal end 38 with respect to the bottom surface 26 and the distal end 38 of each of the bolts 36 is spaced from the bottom surface 26. Each of the bolts 36 is positioned adjacent to the second end 30 and the bolts 36 are spaced apart from each other. A pair of brackets 40 is provided and each of the brackets 40 has a pair of holes 42 each extending through the brackets 40. Each of the holes 42 in each of the brackets 40 has a respective one of the bolts 36 on the board 22 associated with each of the skateboards 12 extending through the holes 42. Moreover, each of the brackets 40 extends across the second end 30 of the board 22 associated with each of the skateboards 12 for attaching the skateboards 12 together. A plurality of nuts 44 is each threadable onto a respective one of the bolts 36 when the brackets 40 are positioned on the bolts 36 for attaching the brackets 40 to the bolts 36.

Each of the pair of rollers 14 on each of the skateboards 12 comprises a skateboard truck 46 which is coupled to the bottom surface 26 of the board 22. The skateboard truck 46 is oriented such that an axle portion 48 of the skateboard truck 46 is spaced from the bottom surface 26 and extends laterally across the bottom surface 26. The skateboard truck 46 associated with each of the rollers 14 is positioned adjacent to a respective one of the first end 28 and the second end 30 of the board 22. The skateboard truck 46 includes a pair of wheels 50 that is each rotatably coupled to respective ends 52 of the axle portion 48 of the skateboard truck 46 to roll along the support surface 16. The skateboard truck 46 associated with each of the rollers 14 may be a skateboard truck 46 of any conventional design.

Each of the pair of foot restraints 18 on each of the skateboards 12 includes a front restraint 54 and a back restraint 56. The front restraint 54 associated with each of the foot restraints 18 comprises a base panel 58 that has a top side 60, a bottom side 62 and a leading edge 64. The leading edge 64 is curved such that the base panel 58 has a semi-circular shape. The bottom side 62 rests on the top surface 24 of the board 22 such that a toe 66 of the user's shoe 68 can rest upon the base panel 58. The front restraint 54 includes a bounding panel 70 that extends upwardly from the top side 60. The bounding panel 70 is aligned with and is coextensive with the leading edge 64 of the base panel 58 such that the bounding panel 70 forms a curve. In this way the bounding panel 70 can extend around the toe 66 of the user's shoe 68 thereby inhibiting the toe 66 of the user's shoe 68 from sliding forwardly on the base panel 58.

The front restraint 54 associated with each of said foot restraints 18 includes a pair of front bolts 72 that each extends downwardly through the top side 60 and the bottom side 62 of the base panel 58. Each of the front bolts 72 extends through a respective one of the second slots 34 in the board 22 thereby enabling the base panel 58 to be positioned at a selected point along the second slots 34 to accommodate the size of the user's shoe 68. The front restraint 54 associated with each of the foot restraints 18 includes a pair of front nuts 74. Each of the front nuts 74 is threadable onto a receptive one of the front bolts 72 when the front bolts 72 are extended through the respective second slot 34 for retaining the base panel 58 at the selected point along the second slots 34.

The back restraint 56 associated with each of the foot restraints 18 comprises a panel 76 that has a primary end 78, a secondary end 80, a top edge 82 and a bottom edge 84. The panel 76 is concavely arcuate between the primary end 78 and the secondary end 80 such that the panel 76 extends around a heel 86 of the user's shoe 68. The bottom edge 84 rests on the top surface 24 of the board 22 having each of the primary end 78 and the secondary end 80 being directed toward the front restraint 54 associated with a respective foot restraint 18. The back restraint 56 includes a pair of back bolts 88 that each extends downwardly through the top edge 82 and the bottom edge 84 such that each of the back bolts 88 extends substantially beyond the bottom edge 84. Each of the back bolts 88 is extendable through a respective one of the first slots 32 in the board 22 thereby enabling the panel 76 is positioned at a selected point along the first slots 32. In this way the back panel 76 can accommodate the size of the user's shoe 68. The back restraint 56 associated with each of the foot restraints 18 includes a pair of back nuts 90 that is each threadable onto a respective one of the back bolts 88 when the back bolts 88 are extended through the respective first slot for retaining the panel 76 at the selected point along the first slots 32.

In use, each of the brackets 40 is engaged to the respective bolts 36 on the board 22 associated with each of the skateboards 12 to attach the skateboards 12 together. Additionally, the front restraint 54 and the back restraint 56 associated with each of the foot restraints 18 is adjusted to accommodate the user's shoes 68. In this way each of the user's shoes 68 is positioned in a respective foot restraint 18 to facilitate the pair of skateboards 12 to be ridden in the common convention of skateboards 12. The brackets 40 can be removed from the respective bolts 36 on the board 22 associated with each of the skateboards 12 to separate the skateboards 12 from each other. In this way each of the skateboards 12 can be ridden in the common convention of roller skates.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular skateboard assembly for riding either as a skateboard or a pair of roller skates, said assembly comprising:

a pair of skateboards, each of said skateboards including a pair of rollers wherein each of said rollers is configured to roll along a support surface, each of said skateboards being attachable to the other skateboard such that said pair of skateboards extends along a common axis thereby enabling said pair of skateboards to be employed in the common convention of skateboards, each of said skateboards being detachable from each other thereby enabling said pair of skateboards to be employed in the common convention of roller skates, each of said skateboards including a pair of foot restraints wherein said pair of foot restraints on each of said skateboards is configured to restrain a respective one of a user's feet;

wherein each of said pair of foot restraints on each of said skateboards includes a front restraint, said front restraint associated with each of said foot restraints comprising:

a base panel having a top side, a bottom side and a leading edge, said leading edge being curved such that said base panel has a semi-circular shape, said bottom side resting on said top surface of said board wherein said base panel is configured to have a toe of the user's shoe rest upon said base panel; and a bounding panel extending upwardly from said top side, said bounding panel being aligned with and being coextensive with said leading edge of said base panel such that said bounding panel forms a curve wherein said bounding panel is configured to extend around the toe of said user's shoe thereby inhibiting the toe of the user's shoe from sliding forwardly on said base panel; and wherein each of said pair of foot restraints on each of said skateboards includes a back restraint, said back restraint associated with each of said foot restraints comprises a panel having a primary end, a secondary end, a top edge and a bottom edge, said panel being concavely arcuate between said primary end and said secondary end wherein said panel is configured to extend around a heel of the user's shoe, said bottom edge resting on said top surface of said board wherein said back restraint is open adjacent to said top surface of said board such that said back restraint is configured for the user's shoe to rest on said top surface of said board, each of said primary end and said secondary end being directed toward said front restraint associated with a respective foot restraint.

2. The assembly according to claim 1, wherein:

each of said skateboards comprises a board having a top surface, a bottom surface, a first end, and a second end, said board being elongated between said first end and said second end, said first end being rounded, said second end being flattened;

said board having a pair of first slots each extending through said top surface and said bottom surface, each of said first slots being oriented parallel to an axis extending between said first end and said second end, said first slots being spaced apart from each other and being oriented parallel to each other, each of said first slots being positioned closer to said first end than said second end; and said board has a pair of second slots each extending through said top surface and said bottom surface, each of said second slots being oriented parallel to an axis extending between said first end and said second end, said second slots being spaced apart from each other and being oriented parallel to each other, each of said second slots being positioned closer to said first end than said second end, said second end of said board associated with each of said skateboard abutting each other when said pair of skateboards is attached together.

3. The assembly according to claim 2, wherein each of said skateboards includes a pair of bolts, each of said bolts extending downwardly through said top surface and said bottom surface of said board, each of said bolts having a distal end with respect to said bottom surface, said distal end of each of said bolts being spaced from said bottom surface, each of said bolts being positioned adjacent to said second end, said bolts being spaced apart from each other.

4. The assembly according to claim 3, further comprising:

a pair of brackets, each of said brackets having a pair of holes each extending through said brackets, each of said holes in each of said brackets having a respective one of said bolts on said board associated with each of said skateboards extending through said holes such that each of said brackets extends across said second end of said board associated with each of said skateboards for attaching said skateboards together, and a plurality of nuts, each of said nuts being threadable onto a respective one of said bolts when said brackets are positioned on said bolts for attaching said brackets to said bolts.

5. The assembly according to claim 2, wherein each of said pair of rollers on each of said skateboards comprises:

a skateboard truck being coupled to said bottom surface of said board such that an axle portion of said skateboard truck is spaced from said bottom surface and extends laterally across said bottom surface, said skateboard truck associated with each of said rollers being positioned adjacent to a respective one of said first end and said second end of said board; and a pair of wheels, each of said wheels being rotatably coupled to respective ends of said axle portion of said skateboard truck wherein each of said wheels is configured to roll along the support surface.

6. The assembly according to claim 1, wherein said front restraint associated with each of said foot restraints includes:

a pair of front bolts, each of said front bolts extending downwardly through said top side and said bottom side of said base panel, each of said front bolts extending through a respective one of said second slots in said board thereby enabling said base panel to be positioned at a selected point along said second slots wherein said front restraint is configured to accommodate the size of the user's shoe; and a pair of front nuts, each of said front nuts being threadable onto a receptive one of said front bolts when said front bolts are extended through said respective second slot for retaining said base panel at said selected point along said second slots.

7. The assembly according to claim 1, wherein said back restraint associated with each of said foot restraints comprises:

a pair of back bolts, each of said back bolts extending downwardly through said top edge and said bottom edge such that each of said back bolts extends substantially beyond said bottom edge, each of said back bolts being extendable through a respective one of said first slots in said board thereby facilitating said panel being positioned at a selected point along said first slots wherein said back panel is configured to accommodate the size of the user's shoe; and a pair of back nuts, each of said back nuts being threadable onto a respective one of said back bolts when said back bolts are extended through said respective first slot for retaining said panel at said selected point along said first slots.

8. A modular skateboard assembly for riding either as a skateboard or a pair of roller skates, said assembly comprising:

a pair of skateboards, each of said skateboards including a pair of rollers wherein each of said rollers is configured to roll along a support surface, each of said skateboards being attachable to the other skateboard such that said pair of skateboards extends along a common axis thereby enabling said pair of skateboards to be employed in the common convention of skateboards, each of said skateboards being detachable from each other thereby enabling said pair of skateboards to be employed in the common convention of roller skates, each of said skateboards including a pair of foot restraints wherein said pair of foot restraints on each of said skateboards is configured to restrain a respective one of a user's feet, each of said skateboards comprising:

a board having a top surface, a bottom surface, a first end, and a second end, said board being elongated between said first end and said second end, said first end being rounded, said second end being flattened, said board having a pair of first slots each extending through said top surface and said bottom surface, each of said first slots being oriented parallel to an axis extending between said first end and said second end, said first slots being spaced apart from each other and being oriented parallel to each other, each of said first slots being positioned closer to said first end than said second end, said board having a pair of second slots each extending through said top surface and said bottom surface, each of said second slots being oriented parallel to an axis extending between said first end and said second end, said second slots being spaced apart from each other and being oriented parallel to each other, each of said second slots being positioned closer to said first end than said second end, said second end of said board associated with each of said skateboard abutting each other when said pair of skateboards is attached together; and a pair of bolts, each of said bolts extending downwardly through said top surface and said bottom surface of said board, each of said bolts having a distal end with respect to said bottom surface, said distal end of each of said bolts being spaced from said bottom surface, each of said bolts being positioned adjacent to said second end, said bolts being spaced apart from each other;

a pair of brackets, each of said brackets having a pair of holes each extending through said brackets, each of said holes in each of said brackets having a respective one of said bolts on said board associated with each of said skateboards extending through said holes such that each of said brackets extends across said second end of said board associated with each of said skateboards for attaching said skateboards together;

a plurality of nuts, each of said nuts being threadable onto a respective one of said bolts when said brackets are positioned on said bolts for attaching said brackets to said bolts;

each of said pair of rollers on each of said skateboards comprising:

a skateboard truck being coupled to said bottom surface of said board such that an axle portion of said skateboard truck is spaced from said bottom surface and extends laterally across said bottom surface, said skateboard truck associated with each of said rollers being positioned adjacent to a respective one of said first end and said second end of said board; and a pair of wheels, each of said wheels being rotatably coupled to respective ends of said axle portion of said skateboard truck wherein each of said wheels is configured to roll along the support surface;

each of said pair of foot restraints on each of said skateboards including a front restraint and a back restraint, said front restraint associated with each of said foot restraints comprising:

a base panel having a top side, a bottom side and a leading edge, said leading edge being curved such that said base panel has a semi-circular shape, said bottom side resting on said top surface of said board wherein said base panel is configured to have a toe of the user's shoe rest upon said base panel;

a bounding panel extending upwardly from said top side, said bounding panel being aligned with and being coextensive with said leading edge of said base panel such that said bounding panel forms a curve wherein said bounding panel is configured to extend around the toe of said user's shoe thereby inhibiting the toe of the user's shoe from sliding forwardly on said base panel;

a pair of front bolts, each of said front bolts extending downwardly through said top side and said bottom side of said base panel, each of said front bolts extending through a respective one of said second slots in said board thereby facilitating said base panel to be positioned at a selected point along said second slots wherein said front restraint is configured to accommodate the size of the user's shoe; and a pair of front nuts, each of said front nuts being threadable onto a receptive one of said front bolts when said front bolts are extended through said respective second slot for retaining said base panel at said selected point along said second slots;

said back restraint associated with each of said foot restraints comprising:

a panel having a primary end, a secondary end, a top edge and a bottom edge, said panel being concavely arcuate between said primary end and said secondary end wherein said panel is configured to extend around a heel of the user's shoe, said bottom edge resting on said top surface of said board wherein said back restraint is open adjacent to said top surface of said board such that said back restraint is configured for the user's shoe to rest on said top surface of said board, each of said primary end and said secondary end being directed toward said front restraint associated with a respective foot restraint;

a pair of back bolts, each of said back bolts extending downwardly through said top edge and said bottom edge such that each of said back bolts extends substantially beyond said bottom edge, each of said back bolts being extendable through a respective one of said first slots in said board thereby facilitating said panel being positioned at a selected point along said first slots wherein said back panel is configured to accommodate the size of the user's shoe; and a pair of back nuts, each of said back nuts being threadable onto a respective one of said back bolts when said back bolts are extended through said respective first slot for retaining said panel at said selected point along said first slots.

* * * * *